United States Patent [19]

Kubota

[11] Patent Number: 4,797,073

[45] Date of Patent: Jan. 10, 1989

[54] PUMP WITH ROTATING AND RECIPROCATING PISTON

[75] Inventor: Kenichi Kubota, Iwate Prefecture, Japan

[73] Assignee: Tohoku Mikuni Kogyo Kabushiki Kaisha, Japan

[21] Appl. No.: 106,370

[22] Filed: Oct. 9, 1987

[30] Foreign Application Priority Data

Oct. 20, 1986 [JP] Japan ..... 61-159478[U]
Oct. 31, 1986 [JP] Japan ..... 61-167466[U]

[51] Int. Cl.[4] ..... F04B 19/02; F04B 7/06

[52] U.S. Cl. ..... 417/461; 417/500; 92/13.4; 92/13.7; 92/60.5; 184/33

[58] Field of Search ..... 417/500, 461, 492, DIG. 1; 92/13.4, 13.7, 60.5; 184/33, 35; 74/22 R

[56] References Cited

U.S. PATENT DOCUMENTS

| | | | |
|---|---|---|---|
| 1,568,170 | 1/1926 | Bret | 417/461 |
| 1,617,199 | 2/1927 | Coles | 417/500 |
| 2,634,688 | 4/1953 | Jakobsen | 184/35 X |
| 4,034,830 | 7/1977 | Mukai et al. | 184/33 X |
| 4,036,326 | 7/1977 | Mukai et al. | 184/33 X |
| 4,043,711 | 8/1977 | Seino | 417/500 X |
| 4,231,716 | 11/1980 | Kubota et al. | 417/500 X |
| 4,285,642 | 8/1981 | Komhyr | 92/170 X |
| 4,678,411 | 7/1987 | Wieland | 417/500 |

FOREIGN PATENT DOCUMENTS

| | | | |
|---|---|---|---|
| 550250 | 12/1922 | France | 184/35 |
| 117909 | 9/1979 | Japan | 417/500 |
| 117369 | 7/1983 | Japan | 417/500 |
| 245409 | 1/1926 | United Kingdom | 184/35 |

*Primary Examiner*—Paul F. Neils
*Attorney, Agent, or Firm*—Lorusso & Loud

[57] ABSTRACT

A plunger pump has a plunger adapted to slide in the axial direction and rotate by a combination of worm and worm wheel. A cylindrical pump body has an axial extension at one free end through which a control pin extends upwardly at a right angle relative to the extension, while the plunger carried on the pump in a cantilever fashion has an inclined end face cam, an adjustment cam and a worm wheel on the same side as the axial extension. The worm wheel meshes with a worm directly connected to a crankshaft of an engine and the crankshaft is not held on the pump body. As the crankshaft is rotated, the plunger is caused to rotate by meshing engagement of the worm and the worm wheel and at the same time slide in the pump body by contact of the end face cam with the control pin whereby liquid held in the pump chamber is discharged from the delivery port. The axial extension is formed with plural pairs of stepped surfaces and by selecting one pair of the stepped surfaces and extending the subplunger with other one, a volume of the pump chamber can be changed as required, since the control pin has a tapered part at the upper part thereof and the latter contacts the adjustment cam on the plunger.

15 Claims, 2 Drawing Sheets

PUMP WITH ROTATING AND RECIPROCATING PISTON

BACKGROUND OF THE INVENTION

The present invention relates to a plunger pump and more particularly to a plunger pump of the type including a worm for rotating the plunger wherein the worm is not mounted on the pump body.

The plunger pump is intended to suck and deliver fluid by rotational and sliding movement of a plunger within a pump body to open and close a suction port and a delivery port on the plunger.

To rotate the plunger, a worm wheel is formed around the periphery of the plunger or a worm gear is fixedly secured to the periphery of the plunger so that a worm adapted to rotate in association with a crankshaft is brought into meshing engagement with the worm wheel or worm gear. The plunger is adapted to rotate in dependence on the number of revolutions of the crankshaft. So as to allow the plunger to slidably move, the plunger is formed with an end face cam having convexity and concavity and in the pump body is mounted a control cam so that the end face cam of the plunger is normally in contact with the control cam. Owing to the arrangement made in that way, as the plunger is rotated, the plunger slidably moves in the pump body under the effect of the end face cam. Such a plunger pump constructed in the above-described manner is disclosed in U.S. Pat. No. 4,043,711 (corresponding to Japanese Published Pat. No. 25124/1958) or U.S. Pat. No. 4,036,326 (corresponding to Japanese Published Model No. 24374/1980).

Heretofore, rotation of the worm was transmitted from the crankshaft via a speed reduction unit in order to finely adjust a fine flow rate. To this end, a worm shaft is supported on the cylindrical pump body so that the worm meshes with the plunger in the pump body. Accordingly, the pump body is integrally formed with a hump-shaped portion extending at a right angle relative to the direction of sliding movement of the plunger in order to accommodate the worm meshing with the plunger therein, and a hole for holding the worm shaft is formed in the hump-shaped portion. However, the pump body with such a hump-shaped portion integrally formed thereon to hold the worm is difficult to be cast and moreover a long period of time is consumed in precisely machining the plunger and the hole for holding the worm shaft, resulting in the plunger pump being manufactured at an expensive cost.

Adjustment of a flow rate is achieved for a conventional plunger pump by changing the sliding stroke length of the plunger. Specifically, a projection serving as an adjustment cam is provided in the center of an annular end face cam and a control cam face adapted to come in contact with the projection is formed on the peripheral surface at the fore end of a control cam shaft so that the sliding stroke of the plunger is changed by changing the position where the control cam face comes in contact with the projection. This control cam shaft is fitted to the pump body by screw threading and thus the position where the cam surface contacts the projection can be changed by rotating the control cam shaft.

However, due to the fact that the cam surface of the control cam shaft requires high accuracy, manufacturing of the control cam shaft is achieved at an expensive cost. Further, since the stroke of the plunger varies even when the rotational angle of the control cam shaft deviates slightly from its correct position, there is the fear that an exact flow rate can not be obtained.

SUMMARY OF THE INVENTION

The present invention has been made with the foregoing background in mind and its object resides in providing a plunger pump which is so constructed that the worm meshes directly with the worm wheel while the worm shaft is not mounted on the pump body.

Another object of the present invention is to provide a plunger pump which has a simplified body configuration of smaller dimensions and lighter weight.

Another object of the present invention is to provide a plunger pump which assures that the flow rate may be finely adjusted even though the worm is connected directly to a crankshaft.

Further, another object of the present invention is to provide a plunger pump having a casing or body molded of a resinous material at an inexpensive cost.

Yet another object of the present invention is to provide a plunger pump of a design which allows the control shaft to be manufactured at an inexpensive cost and, moreover allows the stroke of the plunger, that is, the flow rate to be adjusted simply and accurately.

To accomplish the above objects, the present invention provides a plunger pump of the type including a worm adapted to be rotated as a crankshaft is rotated, a cylindrical pump body having a bore, a suction port and a delivery port formed therein, the suction port and the delivery port being in communication with the bore, a plunger rotatably and slidably fitted into the bore of the pump body, a pump chamber formed in the plunger, the pump chamber being alternately communicated with the suction port and the delivery port, and an end face cam disposed at the free end of the plunger and extending in the axial direction of the latter. The working surface of the end face cam is inclined relative to the axis of the plunger. An adjustment cam, in the form of a projection centrally located at the free end of the plunger provides a camming functioning in cooperation with the cam face. Engagement means provided on the outer periphery of the plunger is rotatably driven by the worm. Biasing means is provided in the pump for normally biasing the plunger toward a control shaft mounted in the pump body for contact with the end face cam or the adjustment cam. One end part of the plunger is held on the pump body in a cantilevered fashion and the engagement means is disposed in the proximity of the free end of the plunger, the worm is directly connected to the crankshaft of an engine and the worm is directly engaged with the engagement means while the crankshaft is not mounted on the pump body.

The pump body includes an axial extension extending from one free end thereof through which a control pin extends at a right angle relative to the axis of the plunger. The control pin has a tapered part at the end adjacent the plunger and adjustment of the flow rate is achieved by contact of the tapered part of the control pin with the adjustment cam on the plunger. Flowrate may also be changed by exchanging a subplunger, reciprocally mounted within the central bore of the plunger, for another having a different length.

A characterizing feature of the present invention is that the pump body is made of resinous material.

The extension has plural pairs of stepped surfaces which are located symmetrically relative to the control pin. Thus, by properly selecting one pair of stepped surfaces by rotation of the control pin, the position where the end face cam and the adjustment cam come in contact with the control pin for the purpose of adjusting the flow rate can be changed as required.

Other objects, features and advantages of the present invention will become readily apparent from a reading of the following description which has been made in conjunction with the accompanying drawings.

BRIEF DESCRIPTION OF THE DRAWINGS

The present invention will be illustrated in the following drawings.

DESCRIPTION OF THE PREFERRED EMBODIMENT

Now, the present invention will be described in a greater detail hereunder with reference to the accompanying drawings.

Figure 1:
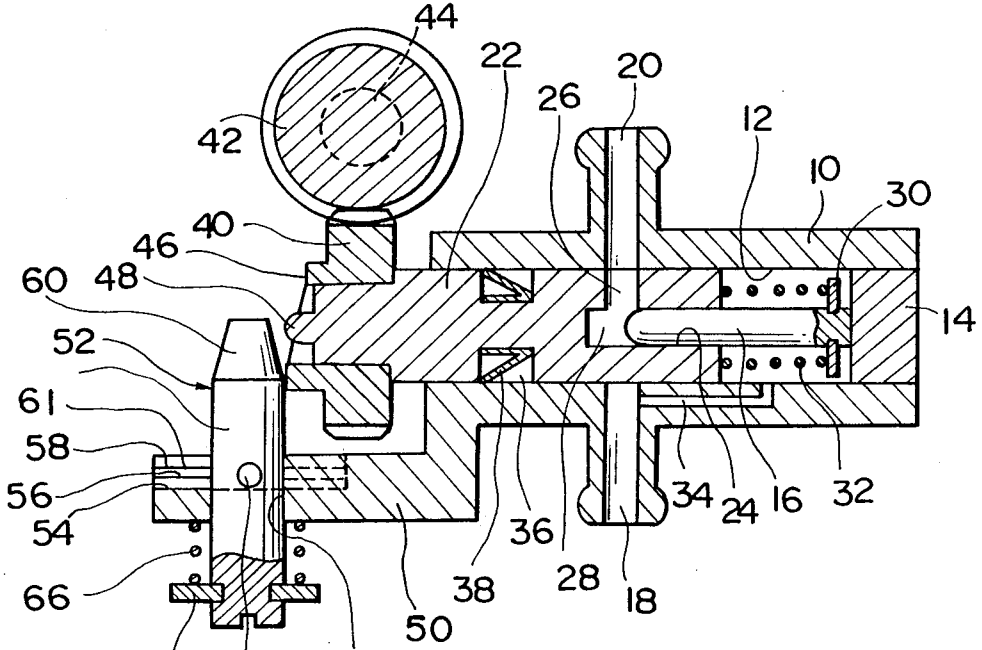
FIG. 1 is a sectional view of a plunger pump in accordance with the present invention.

FIG. 1 is a sectional view of a plunger pump in accordance with an embodiment of the present invention. As is apparent from the drawing, a pump body 10 is configured in a cylindrical shape having a bore 12 of which both ends are open. The right end of the bore 12 as seen in the drawing is liquid-tight closed with a plug 14. A subplunger 16 is fixedly secured to the left side of the plug for adjusting the flow rate a small amount. The pump body 10 is formed with a suction passage 18 and a delivery passage 20 both of which are in fluid communication with the bore 12.

A plunger 22 is rotatably and slidably fitted into the bore 12 of the pump body 10. A hole 24 in which the subplunger 16 is to be inserted is formed along the center axis of rotation at the end of the plunger 22 adjacent the plug 14. Further, a fuel passage 26 extending from the outer cylindrical surface of the plunger 22 to the center axis is provided at a position where it can communicate with the suction passage 18 and the delivery passage 20 and a pump chamber 28 is formed at the juncture where the fuel passage 26 joins the hole 24. The subplunger 16 extends into the interior of the pump chamber 28 so that the delivery flow rate can be varied by exchanging the subplunger 16 for another of a different length thereby changing the volume of the pump chamber 28. A clip 30 is fixedly secured to the end part of the subplunger 16 in the proximity of the plug 14 and a spring 32 is mounted between the clip 30 and the plunger 22 whereby the latter is normally urged away from the plug 14 under the resilient force of the spring 32.

A branch passage 34 extends from the suction passage 18 to a position located between the plunger 22 and the plug 14 so that the plunger 22 slides stably in the presence of liquid filling the bore 12 via the branch passage 34. An annular recess 36 is formed around the periphery of the plunger 22 and a V-ring 38 for preventing leakage is fitted into the annular recess 36.

The plunger 22 is supported in a cantilever fashion in that its one end ("free end") projects from the pump body 10. A worm gear 40 having teeth on the periphery thereof is fixed on the free end of the plunger 22 projecting from the pump body 10. Incidentally, a worm wheel may be formed on the periphery of the plunger 22 at a position in the proximity of the free end thereof in place of the worm gear 40.

A worm 42 meshing with the worm gear 40 is operatively connected directly to a crankshaft 44 of an engine as shown by a dotted line. It should be noted that the worm 42 and the crankshaft 44 are kept independent of the pump body 10, that is, they are not supported by means of the pump body 10.

Incidentally, in order to assure that dirt does not stick to meshing area where the worm gear 40 meshes with the worm, the pump body 10 may have an extension on the open end side so as to integrally form such a hump-shaped part that the periphery of the worm 42 is covered therewith. It should be noted that the hump-shaped part for covering the periphery of the worm 42 may assume any form but it should not be formed to support the crankshaft. Further, the hump-shaped cover may be replaced with a cover which is independent of the pump body 10 so that the meshing area where the worm gear 40 meshes with the worm 42 is free from any dirt.

The worm gear 40 is formed with an end face cam 46 on the free end face side with a camming surface that extends axially a variable distance. Further, a projection 48 serving as an adjustment cam extends from the center of the free end of the plunger 22, that is, centrally of the annular end face cam 46. The free end of the projection 48 extends axially beyond the furthermost position of the end face cam 46. The end face cam 46 may be formed on the end face of the plunger 22, rather than on the end face of the worm gear 40.

Figure 2:
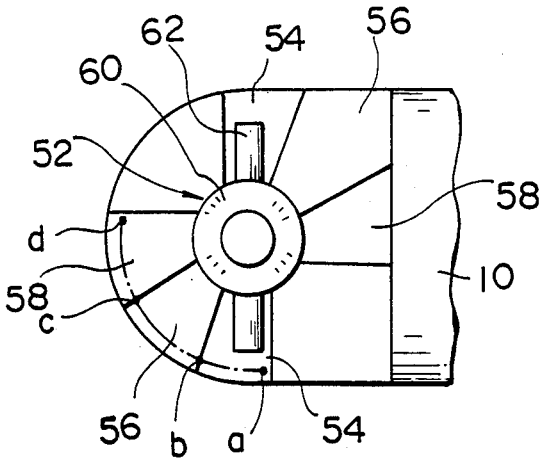
FIG. 2 is a fragmental plan view of the plunger pump as seen in the direction of X mark in FIG. 1, particularly showing the relationship between the control pin and stepped surfaces, and the FIG. 3 is a graphic view of difference in height of the three pair of stepped surfaces shown in the order of a-b-c-d.
Figure 3:
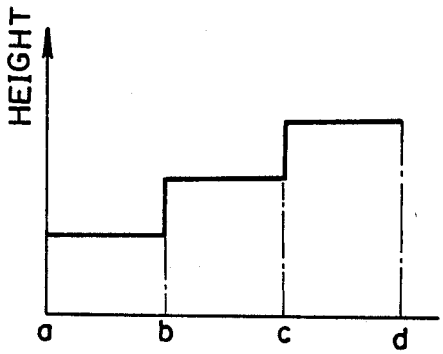

The pump body 10 is integrally formed with an extension, that is, an arm 50 which extends from the fore end of the cylindrical pump body 10 toward the free end of the plunger 22 beyond the worm gear 40. The arm 50 has a hole 51 formed therein through which a control pin 52 is inserted slidably and rotatably. A plurality of stepped surfaces 54, 56 and 58 having different heights are formed on the plunger side of the arm 50. As is apparent from FIG. 2, the stepped surfaces 54, 56 and 58 are so arranged that each has the same height on both sides of the hole 51 in the control pin 52. Further, as shown in FIG. 3, the lowest line corresponds to the stepped surfaces 54, the middle line corresponds to the stepped surfaces 56 and the highest line corresponds to the stepped surfaces 58.

The control pin 52 has a tapered part 60 which tapers outwardly from its uppermost end to a shank portion 61 having a constant diameter. The projection 48 contacts the tapered part 60 of the control pin 52, while the annular cam portion 46 contacts the straight part 61 of the same.

The control pin 52 is provided with a through pin 62 midway of its length which extends at a right angle relative to the axis of the control pin 52. The through pin 62 seats on a stepped surface of the arm 50. The control pin 52 has a clip 64 fixedly secured thereto on the bottom side thereof, that is, at the end opposite its tapered end 60 and a spring 66 between the clip 64 and the arm 50. Thus, the control pin 62 is normally urged in the downward direction so that the through pin 62 is caused to abut against any one pair of the plural stepped surfaces 54, 56 and 58.

Next, operation of the plunger pump as constructed in the above-described manner will be described below.

As the worm 42 directly connected to the crankshaft 44 is rotated, the plunger 22 meshing with the worm 42 is rotated. Since the end face cam 46 secured to the plunger 22 is normally in contact with the control pin 52 under the effect of the resilient force of the spring 32, the plunger 22 is caused to reciprocably move in the pump body 10. As the plunger 22 rotates and slidably moves, fluid is introduced into the pump chamber 28 of the plunger 22 and the thus introduced liquid is then delivered through the delivery passage 20.

Working stroke of the plunger 22 is adjusted by means of the control pin 52. Namely, when the end face cam 46 is rotated to the position of maximum projection, the end face cam 46 contacts the straight part 61 of the control pin 52, and the projection 48 contacts the tapered part 60 at the fore end of the control pin 52 in the course of displacement of the end face cam 46 towards the minimum projected part of the control pin 52. Thus, the sliding stroke of the plunger 22 can be changed by changing the position where the projection 48 contacts the tapered part 60.

Specifically, to adjust the position of the control pin 52, the through pin 62 is unseated from either one pair of the stepped surfaces by pushing the control pin 52 upwardly against resilient force of the spring 66. Thereafter, the through pin 62 is shifted to the next stepped surfaces by turning the control pin 52. Thus, by changing the position of the through pin 62 from one pair of stepped surfaces to another, the control pin 52 can be moved by a predetermined distance in the vertical direction. Since the diameter of the tapered part 60 of the control pin 52 at the fore part thereof which contacts the projection 48 by the above-mentioned operation varies, the working stroke of the plunger can be changed.

Incidentally, the number of stepped surfaces is not specifically limited, so long as it is plural. When the spring 66 serves both as compression spring and twist spring so that the through pin 62 is normally urged toward the higher stepped position, it is possible to inhibit the through pin 62 from moving toward the lower stepped position.

As is apparent from the above description of the plunger pump, the plunger 22 is supported on the pump body in cantilever fashion. The worm 42 meshing with the worm wheel or the worm gear 40 is connected directly to the crankshaft 40 but it is not supported by the pump body 10. Thus, consideration of dimensions relative to the plunger 22 and the worm 42 is not required and the pump body 10 can be designed simply in small dimensions. Consequently, it becomes possible to mold the pump body 10 using resinous material and thereby the molding of the pump body and the machining of the bore are performed simply, resulting in manufacturing cost being reduced remarkably. Further, since the pump body is designed simply in smaller dimensions, the space required for mounting the pump body can be reduced and the extra space can be utilized for other purposes.

Further, since the worm 42 is connected directly to the crankshaft 44, the result is that the number of revolutions of the plunger increases. Due to the fact that a flow rate of the pump is determined by the product of diameter of the pump chamber 28 multiplied by working stroke, the flow rate can be adjusted by changing the length and diameter of the subplunger 16 inserted into the plunger 22 and extending to the pump chamber 28. As a result, the requirement for obtaining a precise flow rate can be met by properly selecting length and diameter of the subplunger 16.

Moreover, the working stroke of the plunger can be adjusted employing simply a control pin 52 with a tapered part 60 at its inner end. Accordingly, there is no need of forming a cam face on the outer periphery at the fore end part of the control pin as is the case with the conventional plunger pump and therefore manufacturing cost can be reduced. Further, adjustment of stroke is achieved merely by placing the through pin on predetermined stepped surfaces. Moreover, operation is easily performed and the working stroke can be determined accurately.

While the present invention has been described merely with respect to a single preferred embodiment, it should of course be noted that it should not be limited only to this but various changes or modifications can be made in a suitable manner without departure from the scope of the invention as defined by the appended claims.

What is claimed is:

1. A plunger pump including:

a worm adapted to be rotated as a crankshaft is rotated, a cylindrical pump body having a bore having a closed end, a suction port and a delivery port formed therein, said suction port and said delivery port communicating with said bore, a plunger having one end rotatably and slidably fitted into the bore of the pump body in a cantilevered fashion with a free end external to said pump body, a pump chamber formed in said plunger, said pump chamber being brought into fluid communication alternately with the suction port and the delivery port, a cam surface on the end face of the free end of the plunger, said cam surface being inclined relative to the axis of the plunger, an adjustment cam in the form of a projection extending axially from said plunger, through the center of said cam surface, at the free end of the plunger to carry out a camming function in cooperation with said cam surface, first engagement means, provided on the outer periphery of the plunger adjacent said free end, for engaging said worm, biasing means for biasing the plunger toward said free end, a control pin mounted on the pump body for contact with said cam surface or the adjustment cam, and wherein said worm is directly connected to the crankshaft and is directly engaged by said first engagement means, with the worm not being held directly by the pump body.

2. A plunger pump as claimed in claim 1, wherein the plunger is formed with a hole extending from said closed end of the bore of the pump body to the pump chamber and a subplunger received within said hole and detachably secured to the pump body, whereby the volume of the pump chamber can be varied by exchanging one subplunger for another.

3. A plunger pump as claimed in claim 1, wherein the pump body is integrally formed with an extension extending outwardly of the free end of the plunger, the control pin being rotatably and slidably fitted through said extension, the extension having formed thereon a plurality of stepped surfaces of different heights, the control pin being provided with second engagement means adapted to abut selectively against one of said stepped surfaces, and the position where the control pin comes in contact with the adjustment cam is such that the control pin has a different effective diameter depending upon the stepped surface selected.

4. A plunger pump as claimed in claim 1, wherein the material used for the pump body is synthetic resin.

5. A plunger pump as claimed in claim 3, wherein each of the stepped surfaces has paired sections symmetrical relative to the control pin.

6. A plunger pump as claimed in claim 3, wherein the control pin is composed of a tapered portion for engaging the end face of said plunger and a portion of constant diameter which extends through the extension.

7. A plunger pump as claimed in claim 3, wherein said second engagement means is a through pin extending through the control pin at a right angle.

8. A plunger pump as claimed in claim 3, wherein the position where the cam surface and the adjustment cam come in contact with the control pin is selected by rotating the control pin together with said through pin and placing said through pin on the selected stepped surfaces.

9. A plunger pump of the type rotably driven by a crankshaft, said plunger pump comprising:

a cylindrical pump body having a central, longitudinal bore, a suction port and a delivery port, said bore opening through said pump body at one end and closed at the other end;

a plunger rotatably and slidably mounted within said bore and a pumping chamber within said plunger;

rotary drive means for rotating said plunger responsive to rotation of the crankshaft;

means for alternately establishing fluid communication between said pumping chamber and said suction port and between said pumping chamber and said delivery port, as said plunger is rotated;

an end face cam provided on a first end of said plunger, said first end extending beyond said open end of said bore, said end face cam being inclined relative to the axis of the plunger;

a projection extending axially from the center of said first end of said plunger defining a camming surface in cooperation with said end face cam;

biasing means for urging said plunger outward, through the open end of said bore;

a control pin mounted on said pump perpendicular to the axis of said plunger and having a free end continuously engaging said camming surface, thereby limiting the outward movement of said plunger, said free end being tapered so that the diameter of said free end at the point of contact with said camming surface is changed by adjustment of the position of said free end of said control pin relative to the axis of said plunger;

and means for adjusting said position of said free end of said control pin.

10. The plunger pump of claim 9 wherein said rotary drive means comprises a worm wheel fixed to the periphery of said plunger adjacent said camming surface and a worm meshed with said worm wheel and directly driven by the crankshaft, neither the worm nor the crankshaft being supported by said pump body.

11. A plunger pump in accordance with claim 9 wherein said pump body is fabricated of a synthetic resin.

12. A plunger pump in accordance with claim 9 wherein said pumping chamber is a bore extending axially from a second end of said plunger adjacent said closed end of said central bore and further comprising a subplunger mounted on the pump body and extending axially into said pump chamber bore.

13. A plunger pump in accordance with claim 12 wherein said subplunger is detachably mounted on said pump body whereby the volume of the pumping chamber can be changed by exchanging said subplunger for another subplunger of a different length.

14. A plunger pump in accordance with claim 9 wherein said pump body comprises:

an axially extending arm member having, on one surface thereof, a plurality of steps, said control pin being mounted in said arm member and having engaging means for engaging a selected one of said steps, whereby said selected step determines said position of said free end of said control pin relative to the axis of said plunger.

15. A plunger pump in accordance with claim 14 wherein said engaging means is a through pin extending through said control pin at a right angle thereto.

* * * * *

UNITED STATES PATENT AND TRADEMARK OFFICE

CERTIFICATE OF CORRECTION

PATENT NO. : 4,797,073

DATED : January 10, 1989

INVENTOR(S) : Kenichi KUBOTA

It is certified that error appears in the above-identified patent and that said Letters Patent is hereby corrected as shown below:

Column 1, line 31, "or" should read --and--;

line 36, delete "a fine" insert --the--; and line 62, after "the", second instance, insert --control--.

Column 3, line 54, delete "the" insert --one--.

Column 5, line 22, "towards" should read -- toward --;

line 28, delete "of".

Signed and Sealed this

Twelfth Day of December, 1989

*Attest:*

JEFFREY M. SAMUELS

*Attesting Officer* *Acting Commissioner of Patents and Trademarks*